US007197889B2

(12) United States Patent
Wakatsuki et al.

(10) Patent No.: US 7,197,889 B2
(45) Date of Patent: Apr. 3, 2007

(54) COOLING UNIT

(75) Inventors: Yuji Wakatsuki, Toyoake (JP); Hideji Ota, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 11/212,163

(22) Filed: Aug. 26, 2005

(65) Prior Publication Data

US 2006/0042297 A1 Mar. 2, 2006

(30) Foreign Application Priority Data

Aug. 26, 2004 (JP) ..... 2004-247139

(51) Int. Cl.
*F25B 41/00* (2006.01)
*F25B 49/00* (2006.01)

(52) U.S. Cl. ..... 62/196.4; 62/197

(58) Field of Classification Search ..... 62/196.4, 62/197

See application file for complete search history.

(56) References Cited

U.S. PATENT DOCUMENTS 6,220,042 B1 * 4/2001 Robillard et al. ..... 62/173
2003/0126874 A1 * 7/2003 Stensrud et al. ..... 62/196.4

* cited by examiner

*Primary Examiner*—Cheryl Tyler
*Assistant Examiner*—B. Clayton McCraw
(74) *Attorney, Agent, or Firm*—Koda & Androlia

(57) ABSTRACT

A cooling unit wherein devices are divided so as to be installed in each of an outdoor unit and indoor unit, for downsizing the indoor unit and reducing its pipe-line cost.

The cooling unit disposes a compressor, a condenser and a liquid receiver R in the outdoor unit, and disposes an expansion means and an evaporator in the indoor unit. The outdoor unit comprises a first bypass pipe closed by a first bypass valve so as to open/close freely. The indoor unit comprises a second bypass pipe, which is closed by a second bypass valve so as to open/close freely. The units are connected by a liquid pipe used as a supply line for refrigerant or hot gas by selecting a refrigerant supply line among the bypass valves and the open/close valves, and by a gas pipe communicating the evaporator to the compressor.

3 Claims, 3 Drawing Sheets

COOLING UNIT

BACKGROUND OF THE INVENTION

1. Technical Field

The present invention relates to a cooling unit wherein the component devices thereof are divided between an outdoor unit installed outdoors and an indoor unit installed indoors for disposition.

2. Description of the Related Art

Various automatic ice making machines which comprise an ice making system are used in a favorable manner in a kitchen of facilities such as a coffee shop, a restaurant or the like, wherein an evaporator led from a cooling unit comprising a compressor, a condenser, a fan motor and the like is disposed in an ice making section; ice making water is circulatingly supplied to the ice making section which is cooled by vaporized refrigerant supplied to the evaporator so as to make an ice block; and the obtained ice block is melted and released by supplying hot gas to the evaporator. For such automatic ice making machines, the type is suggested in which devices comprising the cooling unit are divided between an outdoor unit installed outdoors and an indoor unit installed indoors for arrangement (for example, see U.S. Pat. No. 6,196,007 or Japanese Unexamined Patent Publication (Kokai) No. 2003-336943).

In a cooling unit 10 disclosed in U.S. Pat. No. 6,196,007, as shown in FIG. 3, an outdoor unit 12 comprises a compressor unit 12*a* in which a compressor CM, a liquid receiver R and an accumulator AR are installed; and a condenser unit 12*b* in which a condenser CD and a fan motor FM for cooling the condenser CD are installed. An expansion means EV and an evaporator EP are installed in an indoor unit 14. The cooling unit 10 comprises a cooling circuit 16 which cools an ice making section 20 by condensing and liquefying vaporized refrigerant compressed by the compressor CM by cooling using the fan motor FM in the condenser CD located downstream, thereby evaporating liquefied refrigerant depressurized through the liquid receiver R by the expansion means EV from the evaporator EP so as to make the refrigerant vaporize, and the cooling circuit 16 then returns to the compressor CM. The cooling unit 10 further comprises a bypass circuit 18 for warming the evaporator EP so as to induce the ice block made in the ice making section 20 to be separated and released from the ice making section 20 by supplying high-temperature and pressure vaporized refrigerant compressed by the compressor CM directly to the evaporator EP as hot gas without passing through the condenser CD and the expansion means EV. Specifically, the outdoor unit 12 and the indoor unit 14 are communicably connected by the following three refrigerant pipe-lines 22: a liquid pipe 22*a* connecting the liquid receiver R to the expansion means EV; a gas pipe 22*b* connecting the evaporator EP to the compressor CM through the accumulator AR; and a hot gas pipe 22*c* for supplying hot gas to the evaporator EP from the compressor CM without passing through the condenser CD and the expansion means EV.

Japanese Unexamined Patent Publication (Kokai) No. 2003-336943 discloses, as shown in FIG. 4, a cooling unit 30 in which a liquid receiver R is installed on the side of an indoor unit 14. The cooling unit 30 can diverge liquefied refrigerant introduced from the condenser CD of the outdoor unit 12 to the indoor unit 14 through the liquid pipe 22*a* by a three-way valve 24 so as to supply it to either the liquid receiver R or a bypass pipe 19. Specifically, switching the three-way valve 24 to the liquid receiver R side supplies liquefied refrigerant to the evaporator EP through an expansion means EV so as to form a cooling circuit 16 for cooling an ice making section 20. On the contrary, switching the three-way valve 24 to the bypass pipe 19 side supplies liquefied refrigerant to the evaporator EP without passing through the expansion means EV so as to form a bypass circuit 18 for warming the ice making section 20. It is to be noted that the same device as in the cooling unit 10 of U.S. Pat. No. 6,196,007 has the same number in FIG. 4.

SUMMARY OF THE INVENTION

The cooling units 10, 30 disclosed in U.S. Pat. No. 6,196,007 and Japanese Unexamined Patent Publication (Kokai) No. 2003-336943, respectively, can avoid the lowering of the cooling efficiency of the evaporator EP caused by heat exhaustion from the compressor CM by disposing the compressor CM outdoors. The cooling unit 10 of U.S. Pat. No. 6,196,007, which requires the outdoor unit 12 and the indoor unit 14 to be connected by the three refrigerant pipe-lines 22*a*, 22*b*, 22*c*, has drawbacks in that the pipe-line cost becomes high and cooling efficiency decreases since a large amount of refrigerant has to circulate all over the cooling unit 10 thereby running short of refrigerant. In contrast, the cooling unit 30 of Japanese Unexamined Patent Publication (Kokai) No. 2003-336943, which requires the two refrigerant pipe-line 22*a*, 22*b* for connecting the outdoor unit 12 and the indoor unit 14, can reduce the pipe-line cost. However, since the liquid receiver R is installed in the indoor unit 14, the size of the indoor unit 14 increases for accommodating the installation of the liquid receiver R.

Accordingly, the present invention is proposed to solve the above-mentioned problems inherent in cooling units according to the related art in a favorable manner, and it is an object of the present invention to provide a cooling unit capable of downsizing the indoor unit and reducing the pipe-line cost.

In order to overcome the above-mentioned problems and to achieve desired goals, a cooling unit, wherein a compressor and a condenser are located in an outdoor unit; an expansion means and an evaporator are located in an indoor unit; liquefied refrigerant from the condenser is supplied to the evaporator through a first pipeline system and the expansion means; and the evaporator is configured so that vaporized refrigerant which has been cooled returns to the compressor through a second pipeline system, is characterized by comprising the following:

a liquid receiver installed in the outdoor unit, being connected to the first pipeline system on the downstream side of the condenser;

a first bypass pipe disposed in the outdoor unit, diverging from the downstream side of the compressor so as to connect to the first pipeline system on the downstream side of the liquid receiver;

a second bypass pipe disposed in the indoor unit, diverging from the first pipeline system on the upstream side of the expansion means so as to connect to the upstream side of the evaporator; and a switch means disposed in each of the first and second bypass pipes and the first pipeline system, for switching a refrigerant supply line to either one of a state in which liquefied refrigerant from the liquid receiver is supplied to the expansion means through the first pipeline system, or a state in which vaporized refrigerant from the compressor is supplied to the evaporator through the first pipeline system.

In the above mentioned cooling unit, said switch means is composed of a first bypass valve and second bypass valve each of which being intermediately inserted in the corresponding bypass pipe for opening/closing the relevant bypass pipe freely as well as a first open/close valve inserted on the upstream side of a connection to the first bypass pipe in said first pipeline system; and a second open/close valve inserted on the downstream side of a junction of the second bypass pipe in the first pipeline system.

DESCRIPTION OF THE PREFERRED EMBODIMENTS

Figure 3:
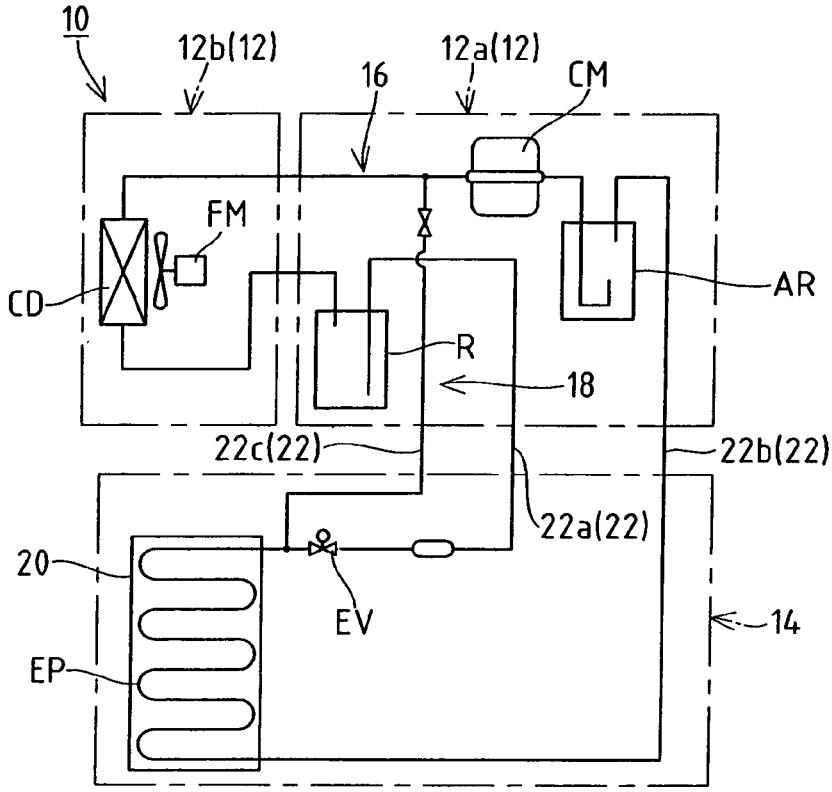
FIG.3 (PRIOR ART)
FIG. 3 is a schematic diagram showing a conventional cooling unit.
Figure 4:
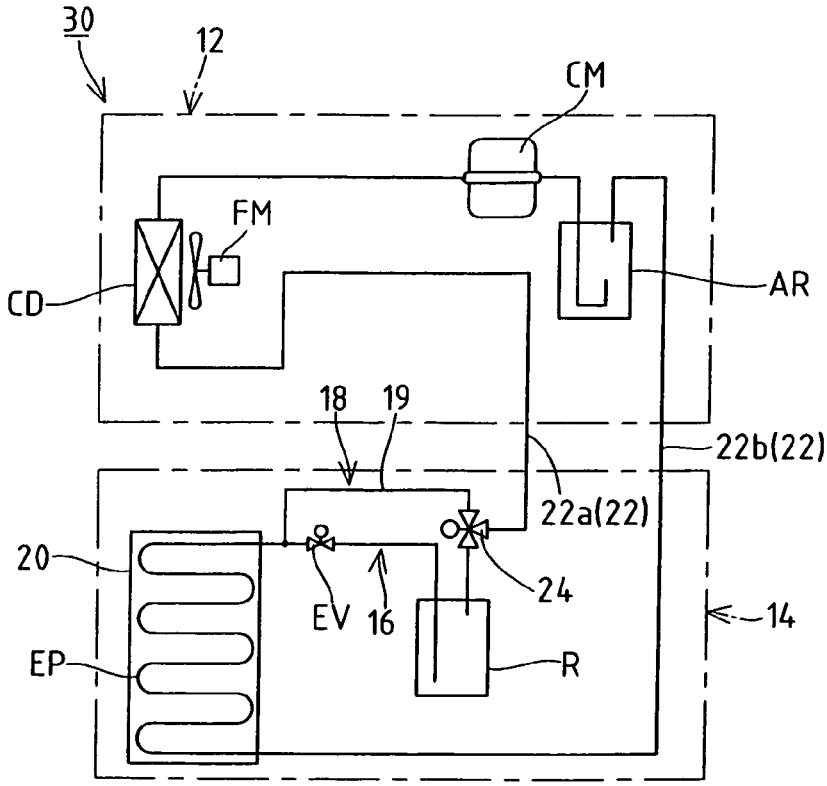
FIG.4 (PRIOR ART)
FIG. 4 is a schematic diagram showing another conventional cooling unit.

Hereinafter, a cooling unit of the present invention will be described by way of preferred embodiments with reference to the accompanying drawings. For convenience of explanation, the components identical to the components shown in FIG. 3 or FIG. 4 have the same reference number and the detailed description thereof is omitted. In the embodiments, a description is given for a case in which a cooling unit according to the present invention is applied to an automatic ice making machine.

First Embodiment

Figure 1:
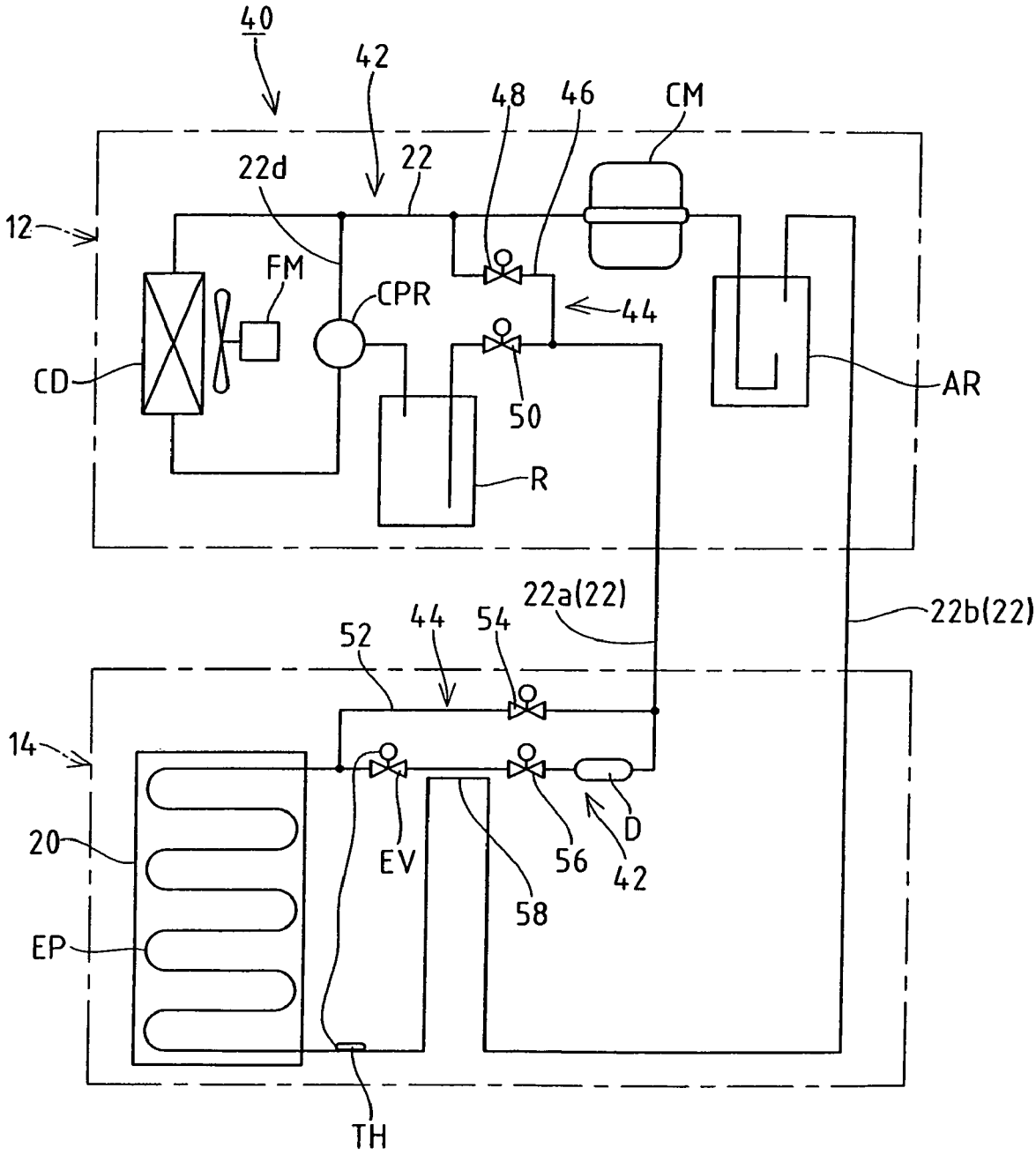
FIG. 1 is a schematic diagram showing a cooling unit according to preferred First Embodiment of the present invention.

FIG. 1 is a schematic diagram showing a cooling unit 40 according to preferred First Embodiment of the present invention. The cooling unit 40 of First Embodiment basically comprises a compressor CM, a condenser CD and a liquid receiver R which are disposed in an outdoor unit 12 installed outdoors; and an expansion means EV and an evaporator EP which are disposed in an indoor unit 14 installed indoors, wherein a cooling circuit 42 is formed so as to cool an ice making section 20 in which the evaporator EP is located, by connecting each device using a refrigerant pipe-line 22 communicably so as to circulate refrigerant. Specifically, in the outdoor unit 12, the cooling circuit 42 condenses and liquefies vaporized refrigerant compressed by the compressor CM so as to make the refrigerant liquefy by supplying the refrigerant to the condenser CD through the refrigerant pipe-line 22. Then, after accumulating in the liquid receiver R temporarily, the liquefied refrigerant is supplied to the indoor unit 14 through a liquid pipe (first pipeline system) 22*a*. The liquefied refrigerant supplied to the indoor unit 14, after removing moisture contained in the refrigerant using a drier D, is depressurized using the expansion means EV, being expanded and vaporized in the evaporator EP at once. As a result, the evaporator EP is forced to be cooled, thereby cooling the ice making section 20 in heat exchange with the ice making section 20. The vaporized refrigerant evaporated in the evaporator EP then repeats a cycle of returning to the compressor CM through a gas pipe (second pipeline system) 22*b*. By supplying ice making water to the ice making section 20 cooled in such a refrigerant cycle, the ice making water is frozen so as to perform an ice-making operation for making an ice block. It is to be noted that reference character FM in the drawing denotes a fan motor for air-cooling the condenser CD, being operated during cooling operation. Thus, the devices comprising the cooling unit 40 are divided between the outdoor unit 12 and the indoor unit 14 for installation. The units 12, 14 are communicably connected only by two pipe-lines of the liquid pipe 22*a* and the gas pipe 22*b* so as to form the cooling circuit 42 in which refrigerant circulates. In this configuration, out of the refrigerant pipe-lines 22, the liquid pipe 22*a* means the one which communicates the condenser CD with the expansion means EV, connecting the outdoor unit 12 to the indoor unit 14 while the gas pipe 22*b* means the one which communicates the evaporator EP with the compressor CM, connecting the indoor unit 14 to the outdoor unit 12.

In the outdoor unit 12, a regulator valve CPR is disposed on the downstream side of the condenser CD, upper than the liquid receiver R. The regulator valve CPR, which is installed so as to maintain the liquefied refrigerant circulating on the downstream side of the condenser CD at a prescribed pressure. When the pressure of the liquefied refrigerant is smaller than a set value, the condenser bypass pipe 22*d* diverging from the refrigerant pipe-line 22 upper than the condenser CD opens so that part of the vaporized refrigerant sent pressurized from the compressor CM is supplied to the liquid receiver R without being condensed in the condenser CD. When the pressure of the liquefied refrigerant is larger than a set value, the condenser bypass pipe 22*d* closes so that the whole refrigerant from the compressor CM passes through the condenser CD so as to be supplied to the side of the indoor unit 14 through the liquid pipe 22*a*. In the outdoor unit 12, an accumulator AR is disposed on the upstream side of the compressor CM, which separates liquid part (liquefied refrigerant) from the vaporized refrigerant exchanging heat in the evaporator EP and returning from the indoor unit 14 through the gas pipe 22*b* so as to prevent the liquid part from flowing into the compressor CM.

In addition to the cooling circuit 42, the cooling unit 40 comprises a bypass circuit 44 for supplying hot gas (high-temperature and pressure vaporized refrigerant) to the evaporator EP so as to release the ice block made in the ice making section 20 by melting during deicing operation. Specifically, a first bypass pipe 46 is disposed on the downstream side of the compressor CM in the outdoor unit 12, which diverges from the refrigerant pipe-line 22 connecting the compressor CM to the condenser CD, connecting to the liquid pipe 22*a* on the downstream side of the liquid receiver R. A first bypass valve (switch means) 48 is inserted into the middle of the first bypass pipe 46, which can open/close the pipeline freely. On the downstream side of the liquid receiver R, upper than a connection between the first bypass pipe 46 and the liquid pipe 22*a*, a first open/close valve (switch means) 50 for opening/closing the cooling circuit 42 freely is inserted. Specifically, by opening the first bypass valve 48 when the first open/close valve 50 is closed, hot gas from the compressor CM is led out to the liquid pipe 22*a* through the first bypass pipe 46 without passing through the condenser CD and the liquid receiver R so that the hot gas can be supplied to the indoor unit 14 through the liquid pipe 22*a*.

In the indoor unit 14, a second bypass pipe 52 is disposed, which diverges on the upstream side of a drier D (expansion means EV) of the liquid pipe 22*a* led into the indoor unit 14, and which connects to the refrigerant pipe-line 22 on the downstream side of the expansion means EV, upper than the evaporator EP. Into the second bypass pipe 52, a second bypass valve (switch means) 54 which can open/close the pipeline freely is inserted. On the downstream side of the drier D, upper than the expansion means EV, a second open/close valve (switch means) 56 which can open/close the cooling circuit 42 freely is inserted. Specifically, by opening the second bypass valve 54 when the second open/close valve 56 is closed, hot gas supplied from the outdoor unit 12 to the indoor unit 14 through the liquid pipe 22*a* can be supplied from the second bypass pipe 52 to the evaporator EP without passing through the expansion means EV.

The bypass valves 48, 54 and the open/close valves 50, 56, for which an electromagnetic valve or an automatic valve such as a motor operated valve is employed in a favorable manner, are not limited to a specific valve as long as they open/close arbitrarily under the control of a control means (not shown). Specifically, during ice-making operation, when circulating refrigerant in the cooling circuit 42, the open/close valves 50, 56 open and the bypass valves 48, 54 thereby close the bypass circuit 44. During deicing operation, when circulating hot gas in the bypass circuit 44, the control means gang-controls so as to close the open/close valves 50, 56 for opening the bypass valves 48, 54 according to the operational circumstances of the cooling unit 40.

Thus, the liquid pipe 22*a*, in which liquefied refrigerant circulates during ice-making operation and hot gas circulates during deicing operation, is used as the refrigerant pipe-line 22 forming the cooling circuit 42 and the bypass circuit 44 by selecting a refrigerant supply line among the bypass valves 48, 54 and the open/close valves 50, 56. Therefore, a pipe-line does not have to be disposed exclusively for supplying hot gas from the outdoor unit 12 to the indoor unit 14, and the refrigerant pipe-lines 22 connecting the units 12, 14 can be integrated into the liquid pipe 22*a* and the gas pipe 22*b*.

In First Embodiment, a temperature-operated expansion valve having a thermosensitive tube TH is employed as the expansion means EV. The thermosensitive tube TH is attached to the gas pipe 22*b* on the outlet side of the evaporator EP so as to operate efficiently by opening/closing the expansion valve according to the temperature of the vaporized refrigerant circulating in the gas pipe 22*b* for pressure regulation of the evaporator EP. The cooling circuit 42 comprises a heat-exchange part 58 for bringing the refrigerant pipe-line 22 heading for the expansion valve EV from the drier D closer by a given section to the gas pipe 22*b* heading for the compressor CM from the evaporator EP for heat exchange. The liquefied refrigerant flowing toward the expansion valve EV from the drier D is cooled by the relatively low-temperature vaporized refrigerant flowing out of the evaporator EP, thereby improving the cooling efficiency of the cooling circuit 42.

Operation of First Embodiment

Next, the operation of a cooling unit according to First Embodiment is described. During ice-making operation, the first open/close valve 50 of the outdoor unit 12 opens and the first bypass valve 48 inserted into the first bypass pipe 46 closes, thereby supplying vaporized refrigerant from the compressor CM to the indoor unit 14 through the liquid pipe 22*a*, as liquefied refrigerant, passing through the condenser CD and the liquid receiver R. The liquefied refrigerant supplied through the liquid pipe 22*a* by opening the second open/close valve 56 of the indoor unit 14 and closing the second bypass valve 54 inserted into the second bypass pipe 52 is supplied through the drier D and the expansion means EV to the evaporator EP, as vaporized refrigerant, by the operation of the expansion means EV. By thus opening both of the open/close valves 50, 56 and closing both of the bypass valves 48, 54, the refrigerant circulation to the bypass circuit 44 is controlled; the refrigerant circulates in the cooling circuit 42; the ice making section 20 is forcibly cooled by the evaporator EP; and then an ice block is made in the ice making section 20.

When ice block making progresses in the ice making section 20 and an ice-making completion detection means (not shown) detects the completion of ice-making, the ice-making operation shifts to deicing operation; the control means switches between the bypass valves 48, 54 in conjunction with the switch between the open/close valves 50, 56; the refrigerant supply line is switched from the cooling circuit 42 to the bypass circuit 44. Specifically, during deicing operation, the vaporized refrigerant from the compressor CM flows through the first bypass pipe 46 without passing through the condenser CD and the liquid receiver R by closing the first open/close valve 50 of the outdoor unit 12 and opening the first bypass valve 48 inserted into the first bypass pipe 46. The vaporized refrigerant, therefore, without being liquefied, is supplied to the indoor unit 14 through the liquid pipe 22*a* as a hot gas maintaining a high temperature state. The hot gas supplied through the liquid pipe 22*a* by closing the second open/close valve 56 of the indoor unit 14 and opening the second bypass valve 54 inserted into the second bypass pipe 52, flows through the second bypass pipe 52, being directly supplied to the evaporator EP without passing through the drier D and the expansion means EV. The hot gas circulating in the evaporator EP then warms the ice making section 20, thereby inducing the ice block made in the ice making section 20 to be released.

By thus providing the bypass pipes 46, 52 in each of the outdoor unit 12 and the indoor unit 14 so as to switch between the bypass valves 48, 54 and between the open/close valves 50, 56, the liquid pipe 22*a* can circulate liquefied refrigerant during ice-making operation while hot gas during deicing operation. The liquid pipe 22*a*, therefore, can also be used as a hot gas pipe. Specifically, a pipe-line does not have to be disposed exclusively for supplying hot gas from the outdoor unit 12 to the indoor unit 14, and as a refrigerant pipe-line 22 disposed for connecting the outdoor unit 12 to the indoor unit 14, the configuration of the cooling circuit 42 can pare the required number of pipes down to minimum: only two pipes of the liquid pipe 22*a* and the gas pipe 22*b*. Therefore, the cooling unit 40 of First Embodiment can reduce its pipeline material cost and save time and trouble for the pipeline operation when installing equipment, thereby reducing the cost in a comprehensive manner.

Disposing the compressor CM and the evaporator EP in the separate units 12, 14 can avoid the cooling efficiency of the evaporator EP from decreasing and room temperature from rising caused by heat exhaustion from the compressor CM. In addition, installing the compressor CM and the fan motor FM, which becomes a noise source, in the outdoor unit 12 installed outdoors can improve the quietness of the indoor unit 14. Furthermore, since the liquid receiver R is disposed in the outdoor unit 12 for the cooling unit 40, the liquid receiver R can make regulations so as to avoid refrigerant shortage even when a refrigerant flow changes in the evaporator EP, and the indoor unit 14 can be downsized.

Second Embodiment

Figure 2:
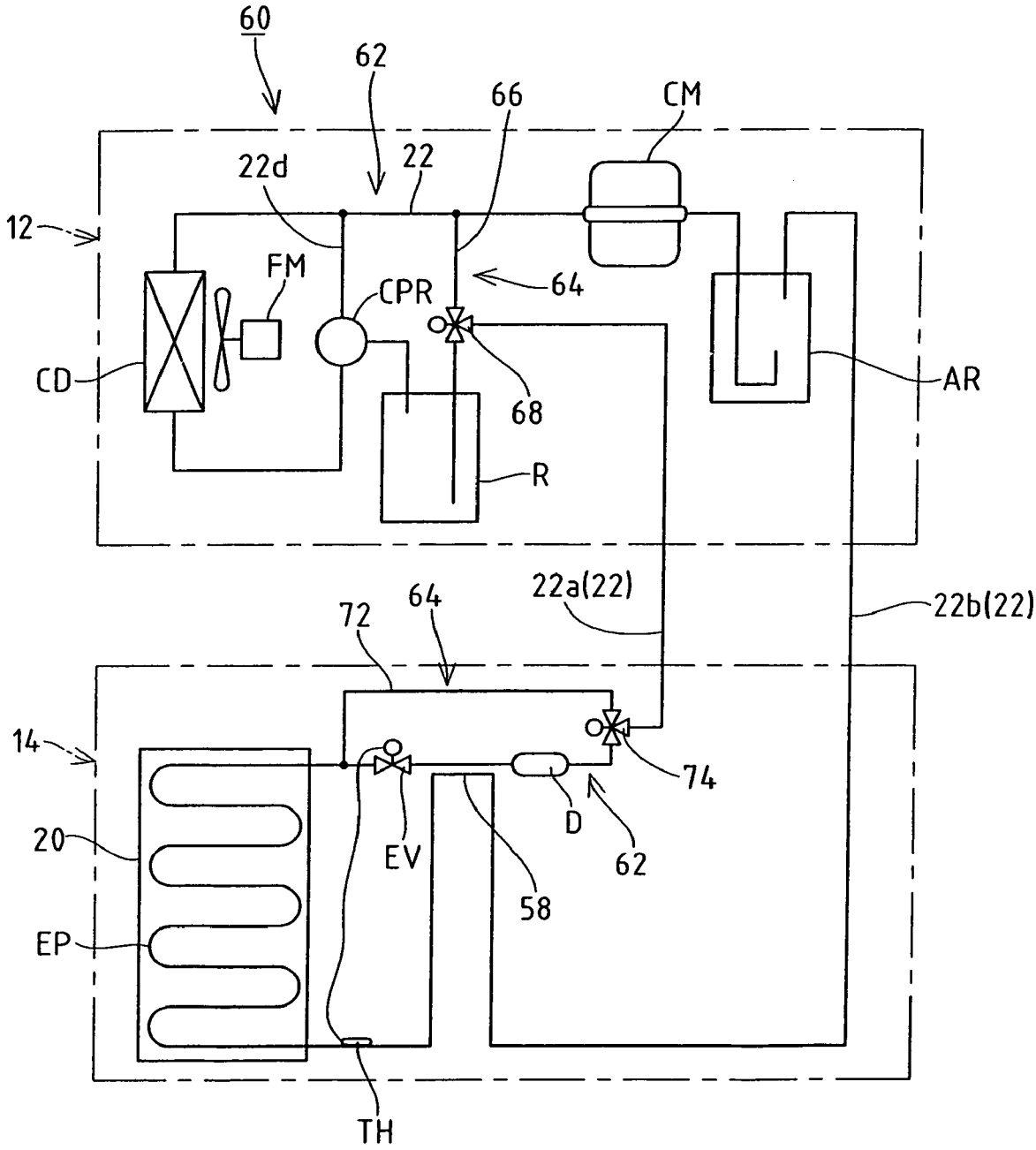
FIG. 2 is a schematic diagram showing a cooling unit according to Second Embodiment.

FIG. 2 is a schematic diagram showing the cooling unit 60 according to Second Embodiment. Since the basic configuration thereof is the same as in First Embodiment, a description is given only for different parts. While the bypass valves 48, 54 and the open/close valves 50, 56 are inserted into the middle of each of the bypass pipes 46, 52 and the liquid pipe 22*a* as a means for switching between the cooling circuit 42 and the bypass circuit 44 in First Embodiment, a switch means is disposed in the connection to or diverging portion from the liquid pipe (first pipeline system) 22*a* of the bypass pipes 66, 72, and a three-way valve is employed as the switch means in Second Embodiment. Specifically, for the cooling unit 60 of Second Embodiment, in the outdoor unit 12, a first bypass pipe 66 is disposed on the downstream side of the compressor CM, which diverges from the refrigerant pipe-line 22 connecting the compressor CM to the condenser CD so as to connect to the liquid pipe 22*a* on the downstream side of the liquid receiver R. In the connection where the first bypass pipe 66 combines with the liquid pipe 22*a*, a first three-way valve 68 is disposed as a switch means so that the pipeline is switched to either one of the cooling circuit 62 or the bypass circuit 64 in the outdoor unit 12. In the indoor unit 14, a second bypass pipe 72 is disposed, which diverges from the liquid pipe 22*a* led to the indoor unit 14 on the upstream side of the drier D (expansion means EV), connecting to the refrigerant pipe-line 22 on the downstream side of the expansion means EV, upper than the evaporator EP. In the diverging portion where the second bypass pipe 72 diverges from the liquid pipe 22*a*, a second three-way valve 74 is disposed as a switch means so that the pipeline is switched to either one of the cooling circuit 62 or the bypass circuit 64 in the indoor unit 14. For the three-way valves 68, 74, it is to be noted that an automatic valve is employed for switching between circuits arbitrarily by the control means (not shown) depending on an operation condition.

During ice-making operation, both of the three-way valves 68, 74 are switched to the side of the cooling circuit 62 so that refrigerant circulates in each of the devices arranged along the cooling circuit 62 in order to cool the ice making section 20. During deicing operation, in contrast, both of the three-way valves 68, 74 are switched to the side of the bypass circuit 64 so that hot gas is allowed to circulate in each of the bypass pipes 66, 68 in order to warm the ice making section 20. For the cooling unit 60 of Second Embodiment, the liquid receiver R is disposed in the outdoor unit 12, and the outdoor unit 12 and the indoor unit 14 are connected by the liquid pipe 22*a* and the gas pipe (second pipeline system) 22*b* in which refrigerant or hot gas circulates depending on an operation condition. Specifically, while Second Embodiment shows an operation and effect similar to those in First Embodiment, since the functions of the bypass valves 48, 54 and the open/close valves 50, 56 of First Embodiment can be brought together into one by employing the three-way valves 68, 74 as a switch means, thereby reducing the number of parts for cost reduction.

According to the cooling unit of the invention of claim 1, since the liquid receiver is disposed in the outdoor unit and both units are connected by the first pipeline system and the second pipeline system used as the supply line for refrigerant or hot gas by selecting a refrigerant supply line of the switch means, the pipeline cost between the units can be reduced thereby downsizing the indoor unit. According to the invention of claim 2, a valve which can close a pipeline freely is employed for each of the bypass pipe and first pipeline system as a switch means, thereby switching between refrigerant supply lines in a favorable manner depending on an operation condition of the cooling unit. Furthermore, according to the invention of claim 3, the three-way valve is employed as a switch means, thereby reducing the number of parts.

What is claimed is:

1. A cooling unit wherein a compressor and a condenser are located in an outdoor unit;

an expansion means and an evaporator are located in an indoor unit;

liquefied refrigerant from said condenser is supplied to the evaporator through a first pipeline system and the expansion means;

the evaporator is configured so that vaporized refrigerant which has been cooled returns to the compressor through a second pipeline system; and a liquid receiver connected to said first pipeline system on a downstream side of said condenser is installed in said outdoor unit, said cooling unit comprising:

a first bypass pipe disposed in said outdoor unit, said first bypass pipe diverging, on a downstream side of said compressor, from a refrigerant pipe-line, which connects said compressor and said condenser, and connecting to said first pipeline system of said outdoor unit on a downstream side of said liquid receiver;

a second bypass pipe disposed in said indoor unit, said second bypass pipe diverging, on an upstream side of the expansion means, from said first pipeline system located in said indoor unit and connecting, on a downstream side of the expansion means, to an upstream side of the evaporator; and a switch means disposed in each of said first and second bypass pipes and said first pipeline system, for switching a refrigerant supply line to either one of a state in which liquefied refrigerant from said liquid receiver is supplied to the expansion means through the first pipeline system, and a state in which vaporized refrigerant from said compressor is supplied to the evaporator through the first pipeline system.

2. The cooling unit according to claim 1, wherein said switch means is composed of a first bypass valve inserted in said first bypass pipe for opening/closing said first bypass pipe freely, a second bypass valve inserted in said second bypass pipe for opening/closing said second bypass pipe freely, a first open/close valve inserted on an upstream side of a connection to the first bypass pipe in said first pipeline system, said first open/close valve being on a downstream side of said liquid receiver; and a second open/close valve inserted on a downstream side of a junction of said second bypass pipe in said first pipeline system, said second open/close valve being on an upstream side of the expansion means.

3. The cooling unit according to claim 1, wherein said switch means comprises a first three-way valve inserted into a connection to the first pipeline system in said first bypass pipe; and a second three-way valve inserted into a diverging portion from the first pipeline system in said second bypass pipe.

* * * * *